US006010364A

United States Patent [19]

Boyd et al.

[11] Patent Number: 6,010,364

[45] Date of Patent: Jan. 4, 2000

[54] ELECTRICAL CONNECTOR WITH GASKET ABUTTING LOCKING SPACER

[75] Inventors: Steven M. Boyd, Warren; Michael J. Bonavita, Russell; Ronald E. Thomas, Warren; Richard P. Walker, Saegertown, all of Pa.

[73] Assignee: Osramsylavania Inc., Danvers, Mass.

[21] Appl. No.: 09/064,340

[22] Filed: Apr. 22, 1998

[51] Int. Cl.[7] ..... H01R 13/40

[52] U.S. Cl. ..... 439/595

[58] Field of Search ..... 439/271, 595, 439/744

[56] References Cited

U.S. PATENT DOCUMENTS 5,913,697 6/1999 Myer et al. ..... 439/595

*Primary Examiner*—Steven L. Stephan
*Assistant Examiner*—Barry M. L. Standig
*Attorney, Agent, or Firm*—W. H. McNeill

[57] ABSTRACT

A connector assembly which includes inner and outer connector housings and a locking spacer attached to the inner housing. The connector assembly may be obtained by the user with the locking spacer in a pre-installed position relative to the inner housing. Such pre-installed assembly includes a gasket contained within the connector assembly and held in place by the locking spacer. Latching members are provided which permit the locking spacer to be moved from the pre-installed position to a final installed position wherein the locking spacer will serve to maintain the gasket, and contacts within the inner housing, in place during use of the connector assembly.

15 Claims, 9 Drawing Sheets

ELECTRICAL CONNECTOR WITH GASKET ABUTTING LOCKING SPACER

TECHNICAL FIELD

The present invention relates to a connector assembly which includes a housing and a locking spacer adapted to be attached thereto. The locking spacer is slidable in the direction of a longitudinal axis of the housings between a first attached position and a second attached position. The present invention particularly relates to the manner in which the locking spacer is attached to the housings and slides from a first attached position to a second attached position to hold in place a gasket and a plurality of contacts within the housings.

BACKGROUND ART

In fabricating an electrical connector assembly, a gasket and a plurality of contacts are typically inserted into a connector housing. During such operation, inserting the gasket properly and securing it in place is important to assure that a satisfactory seal is effected. It is also necessary to adequately secure the contacts in place within the connector assembly housing so that when the connector assembly is electrically and mechanically attached to a mating connector assembly, the contacts are not inadvertently bent or broken and are properly oriented for satisfactory connection with mating contacts.

DISCLOSURE OF THE INVENTION

It is, therefore, an object of this invention to obviate the disadvantages of the prior art.

It is an object of the present invention to provide an enhanced connector assembly.

It is another object of the present invention to provide an improved connector assembly wherein contacts mounted therein are firmly held in place during the mating of the connector assembly with another connector assembly.

It is a further object of the present invention to provide an improved connector assembly wherein proper insertion of a gasket therein is facilitated.

Yet a further object of the present invention is to provide an improved connector assembly wherein a gasket contained therein is satisfactorily held in place.

Another object of the present invention is to provide an improved connector assembly having a pre-installed locking spacer which facilitates the proper installation of contacts and a gasket in a connector housing of the connector assembly.

A further object of the present invention is to provide an improved connector assembly having a pre-installed locking spacer which retains a gasket and contacts in a connector housing of the connector assembly.

A further object of the present invention is to provide an improved connector assembly which reduces bending and breaking of contacts, and incomplete connections between mating contacts, during electrical and mechanical connection of mating connector assemblies.

Yet another object of the present invention is to provide an improved connector assembly which substantially prevents inadvertent entry of wiring in a connector housing.

This invention achieves these and other objects, in one aspect of the invention, by providing a connector assembly which comprises an outer housing, an inner housing and a locking spacer. The outer housing extends in the direction of a longitudinal axis from a base of the outer housing to a first open end. The outer housing provides a first inner cavity therein. The inner housing is positioned within the first inner cavity and extends in the direction of the longitudinal axis from the base to a second open end. The inner housing provides a second inner cavity therein. A space is provided between an outer surface of the inner housing and an inner surface of the outer housing. Such space is structured and arranged to contain a gasket, and the inner housing is structured and arranged for containing a plurality of contacts in the second inner cavity extending towards the second open end. A locking spacer is provided which is structured and arranged for sliding in the direction of the longitudinal axis between a first attached position located between the base and the first open end and a second attached position located between the base and the first attached position.

BRIEF DESCRIPTION OF THE DRAWINGS

This invention may be clearly understood by reference to the attached drawings in which like reference numerals designate like parts and in which.

BEST MODE FOR CARRYING OUT THE INVENTION

Figure 1:
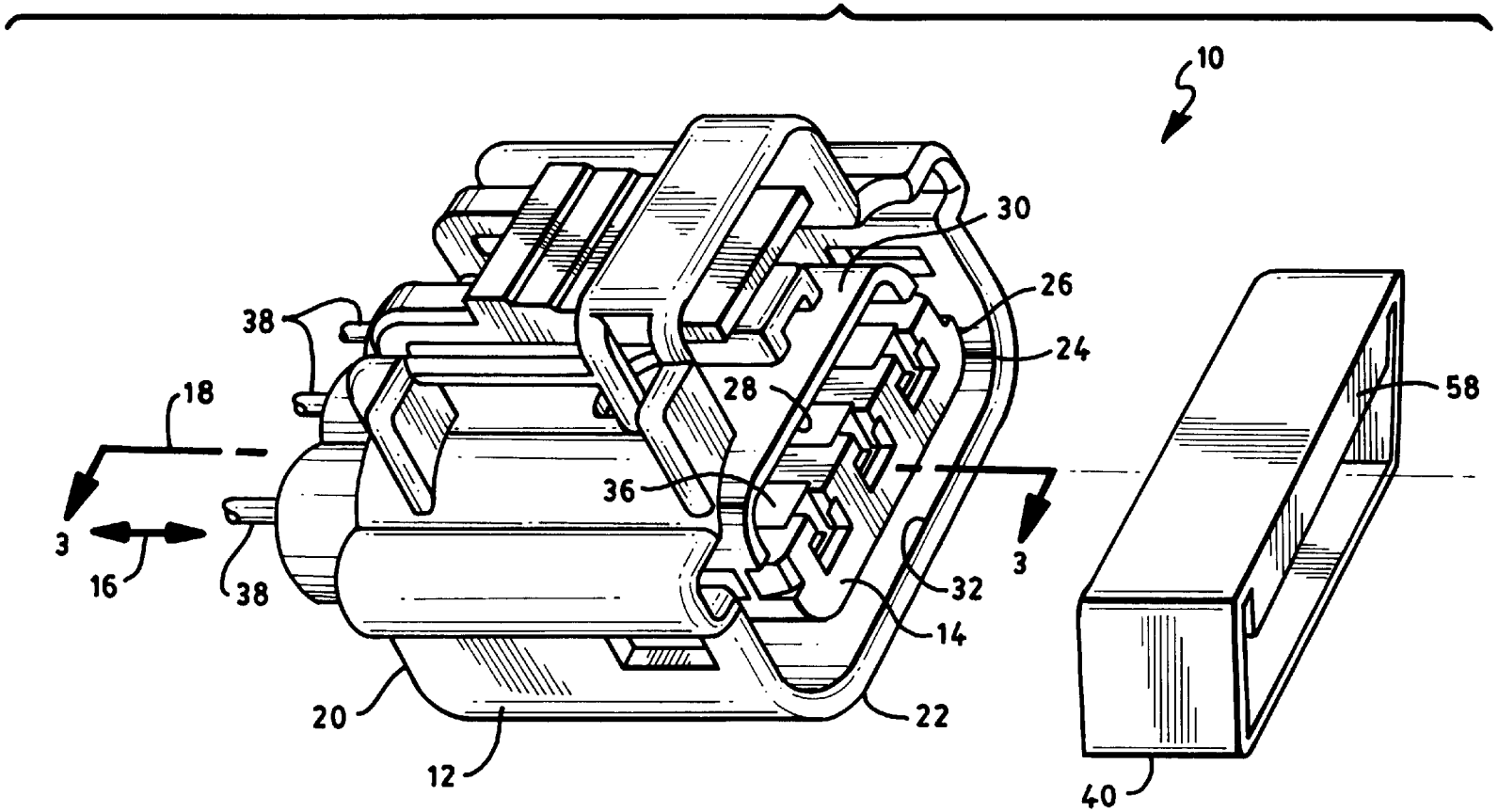
FIG. 1 is an exploded perspective view embodying one form of a connector assembly of the present invention.
Figure 2:
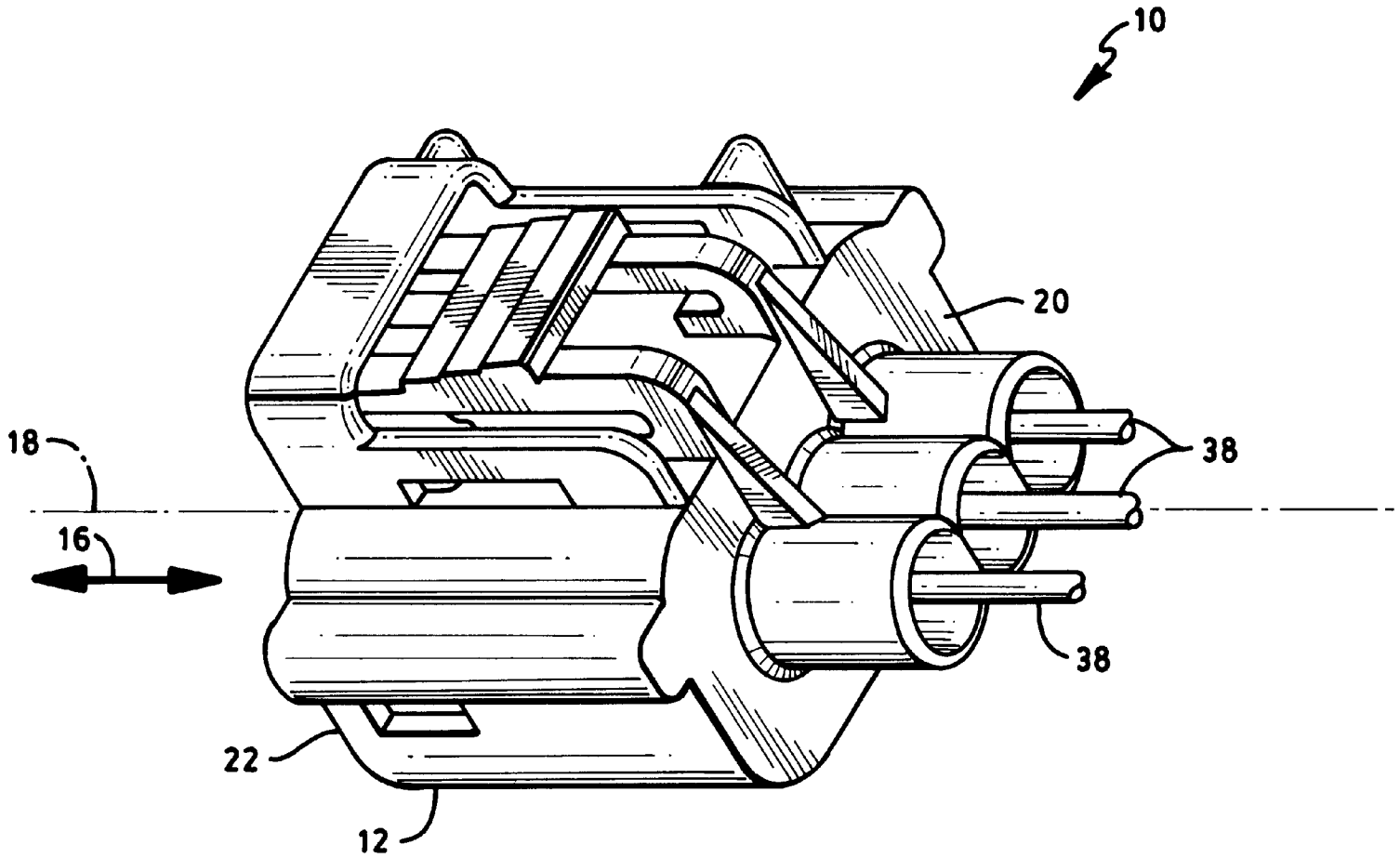
FIG. 2 is a rear perspective view of the connector assembly of FIG. 1 with the locking spacer 40 omitted.

For a better understanding of the present invention, together with other and further objects, advantages and capabilities thereof, reference is made to the following disclosure and appended claims taken in conjunction with the above-described drawings.

The embodiment of this invention which is illustrated in the drawings is particularly suited for achieving the objects of this invention. FIGS. 1 to 7 illustrate one embodiment of a connector assembly 10 of the present invention.

Connector assembly 10 includes an outer housing 12 and an inner housing 14. Outer housing 12 extends in the direction 16 of an axis 18 from a base 20 of the outer housing to a first open end 22. Outer housing 12 provides an inner cavity 24 therein.

The inner housing 14 is positioned within the inner cavity 24 and extends in the direction 16 of axis 18 from the base 20 to a second open end 26. Inner housing 14 provides an inner cavity 28 therein.

Figure 3A:
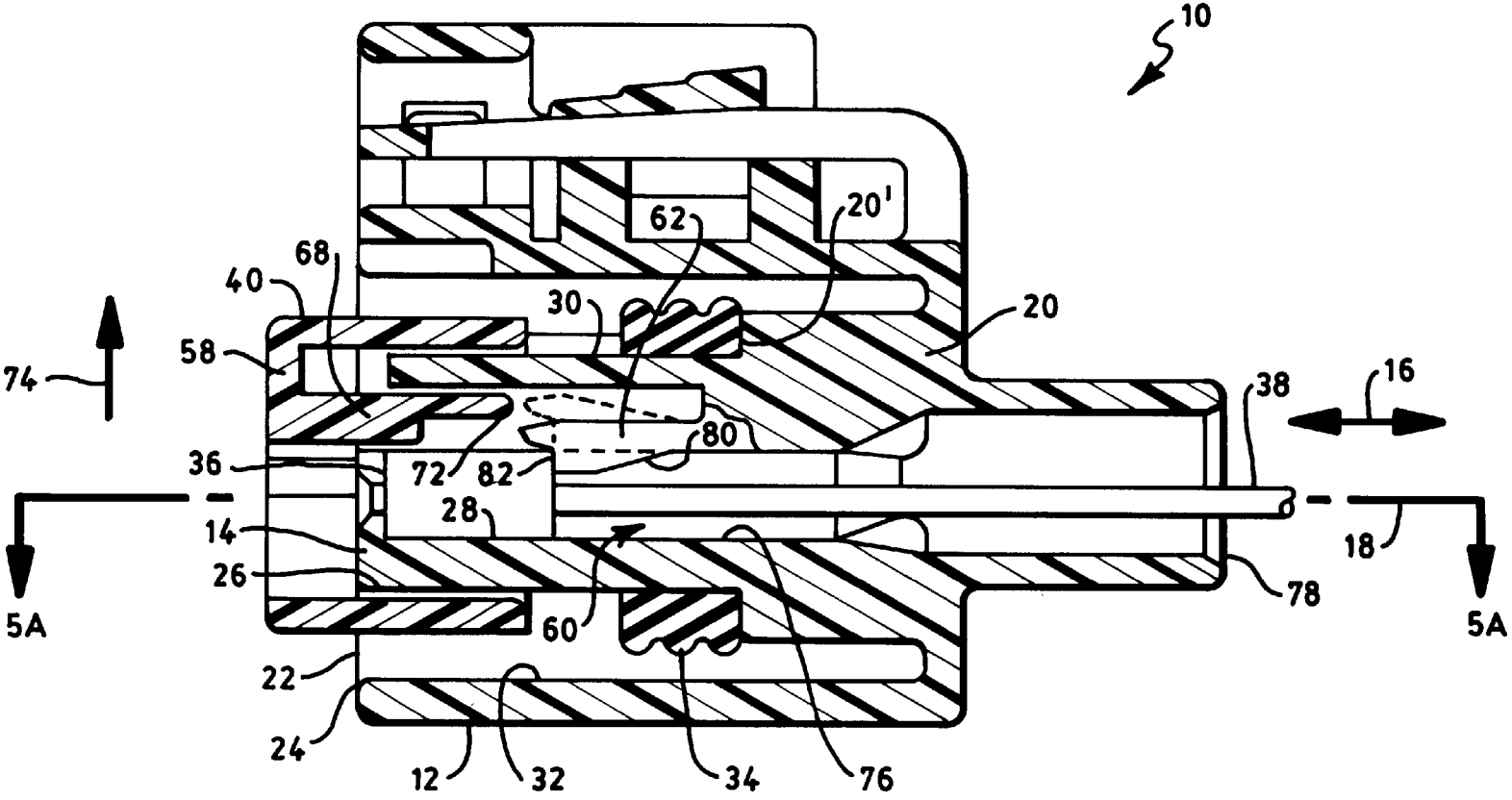
FIG. 3A is a cross section of the connector assembly of FIG. 1 taken along lines 3—3 illustrating the locking spacer 40 in a first attached position.
Figure 3B:
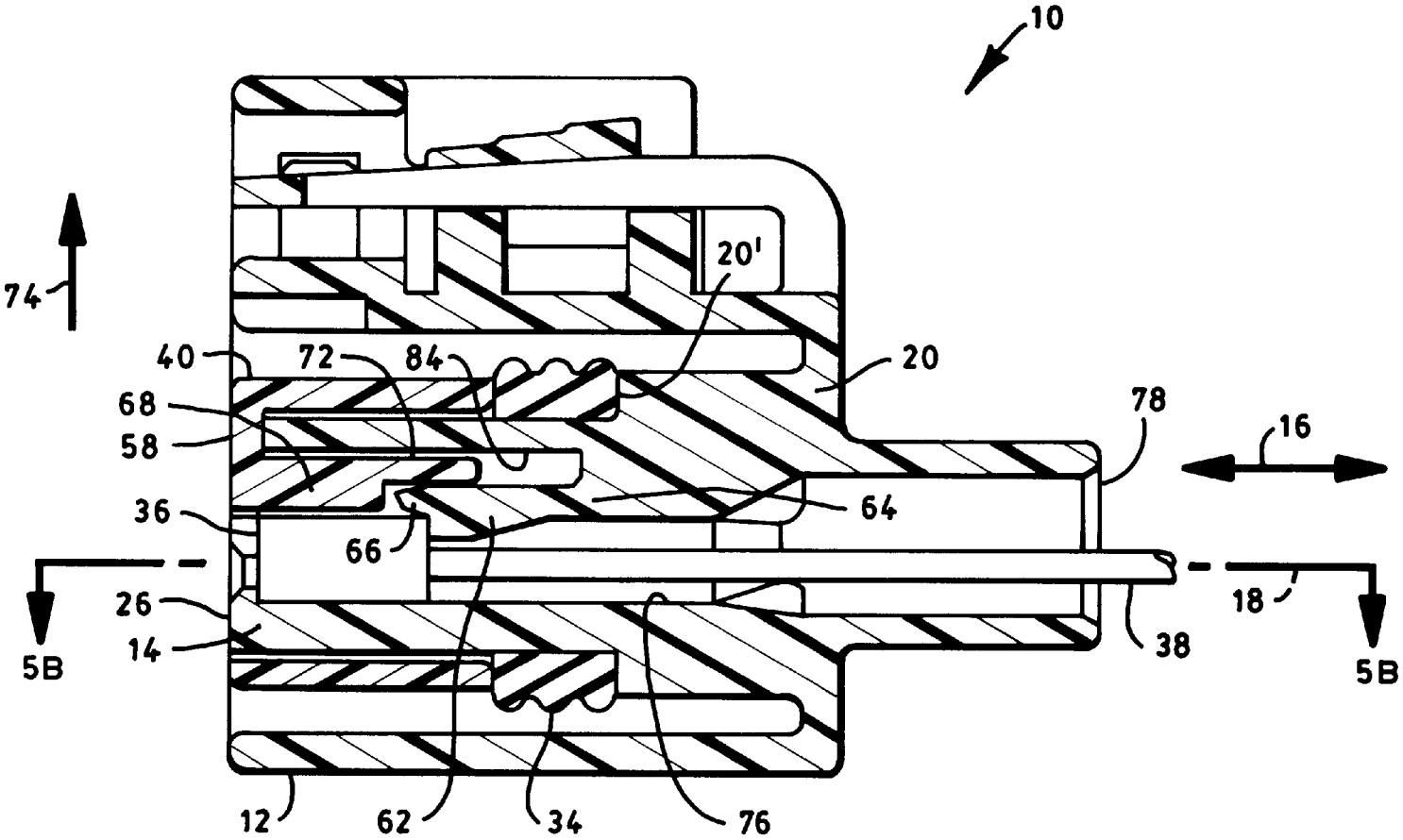
FIG. 3B is a cross section of the connector assembly of FIG. 1 taken along lines 3—3 illustrating the locking spacer 40 in a second attached position.
Figure 4:
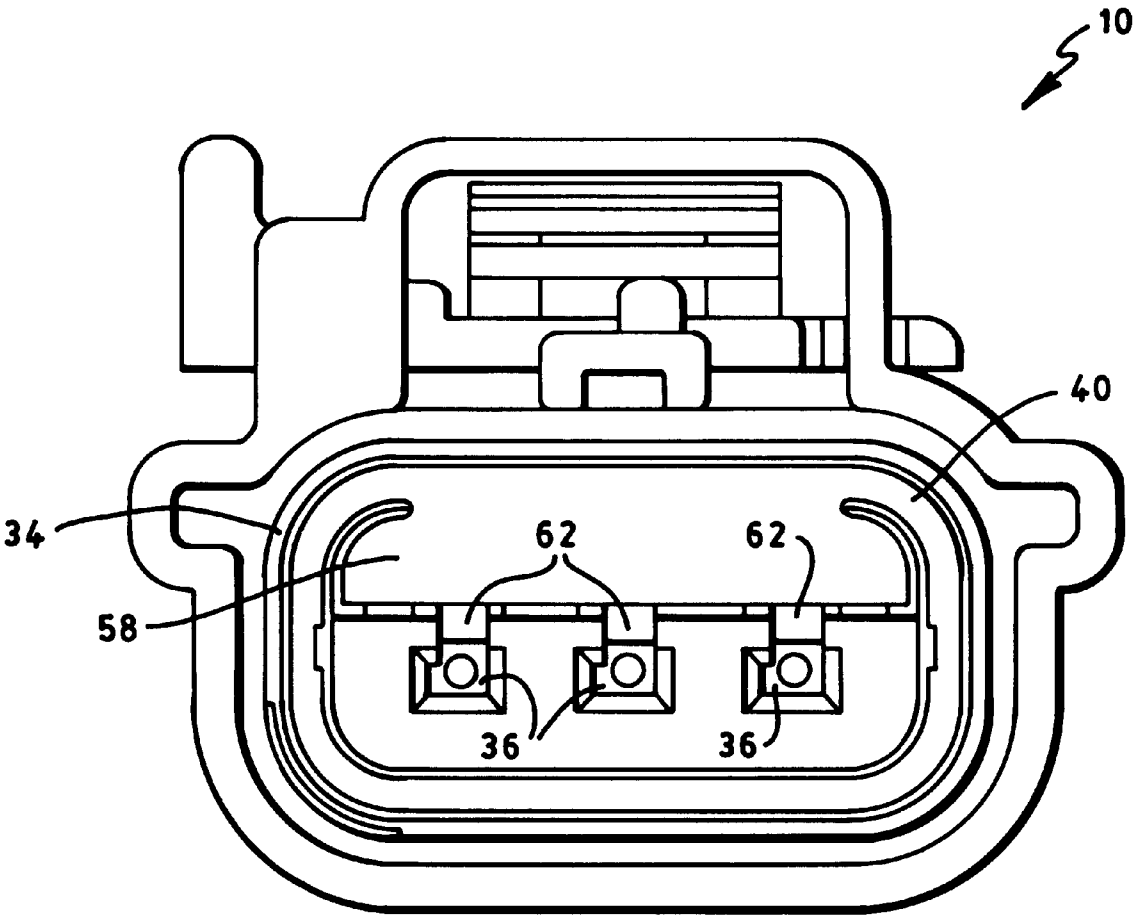
FIG. 4 is a front elevational view of the connector assembly of FIG. 1.

The inner cavity 24 of the outer housing 12 provides a space between an outer surface 30 of the inner housing 14 and an inner surface 32 of the outer housing 12. Such space is structured and arranged to contain a gasket. For example, as illustrated in FIGS. 3A, 3B and 4, a gasket 34 is provided in the space provided by inner cavity 24, the gasket 34 engaging the base 20 at a surface 20' and the outer surface 30 of the inner housing 14.

The inner housing 14 is structured and arranged for containing a plurality of contacts in the second inner cavity 28 extending towards the open end 26. For example, in the embodiment illustrated in FIGS. 3A and 3B, one of such contacts 36 is contained within second inner cavity 28 and extends from a conductor 38 towards the open end 26 of the inner housing 14. Contacts 36 are electrically and mechanically connected to conductors 38 in a conventional manner, as for example, by welding or soldering.

The connector assembly of the present invention includes a locking spacer. For example, in the embodiment illustrated in the drawings, the connector assembly 10 includes a locking spacer 40 which extends in the direction 16 of axis 18 from one open end to another open end. The locking spacer 40 is slidable in the direction 16 between a first attached position and a second attached position. In the first attached position the locking spacer 40 is disengaged from the gasket 34, as illustrated in FIG. 3A, and in the second attached position the locking spacer 40 is engaged with the gasket 34, to sandwich the gasket between the surface 20' of base 20 and the locking spacer, as illustrated in FIG. 3B.

Figure 5A:
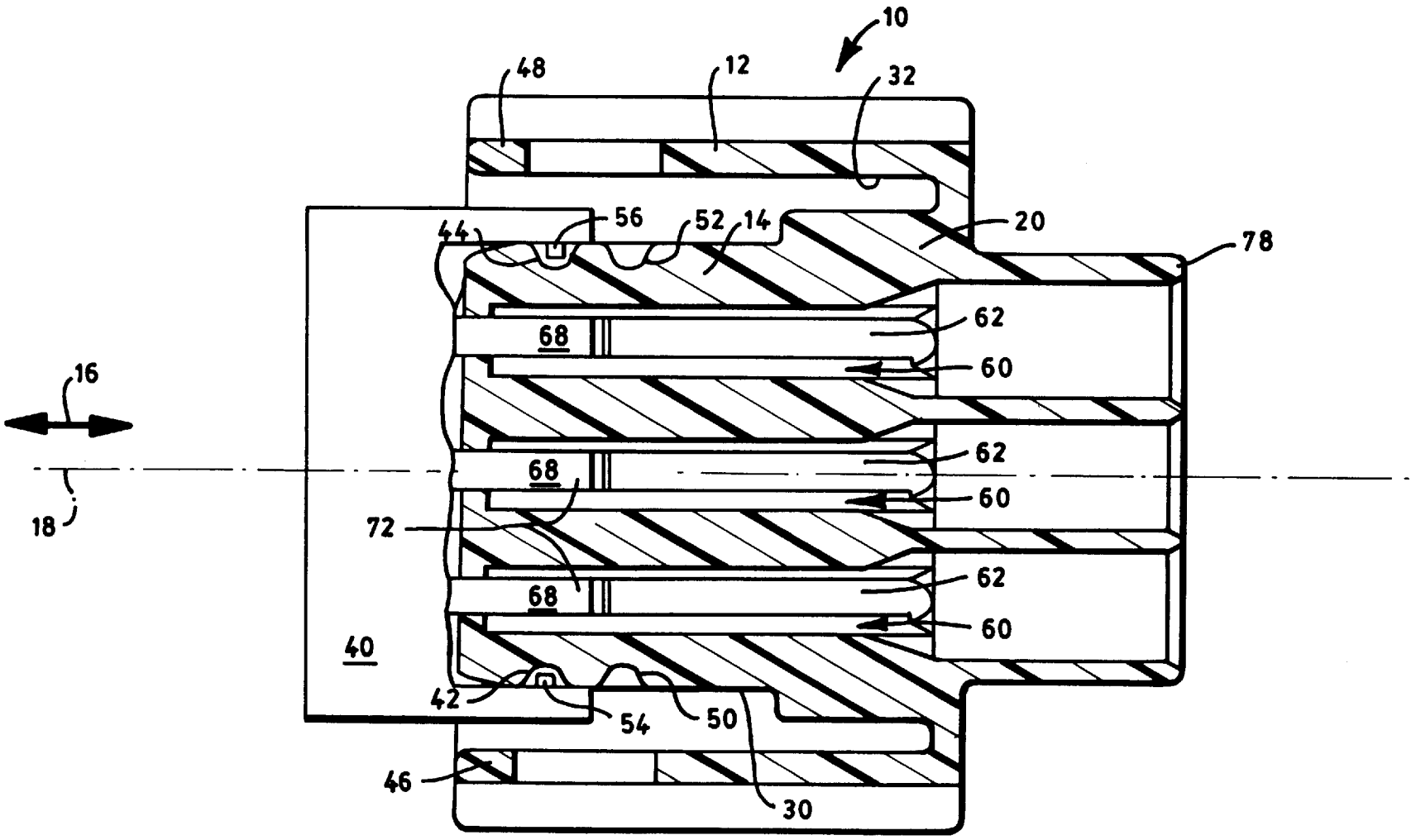
FIG. 5A is a cross section of the connector assembly of FIG. 3A taken along lines 5A—5A with the gasket 34, contacts 36 and conductors 38 omitted.
Figure 5B:
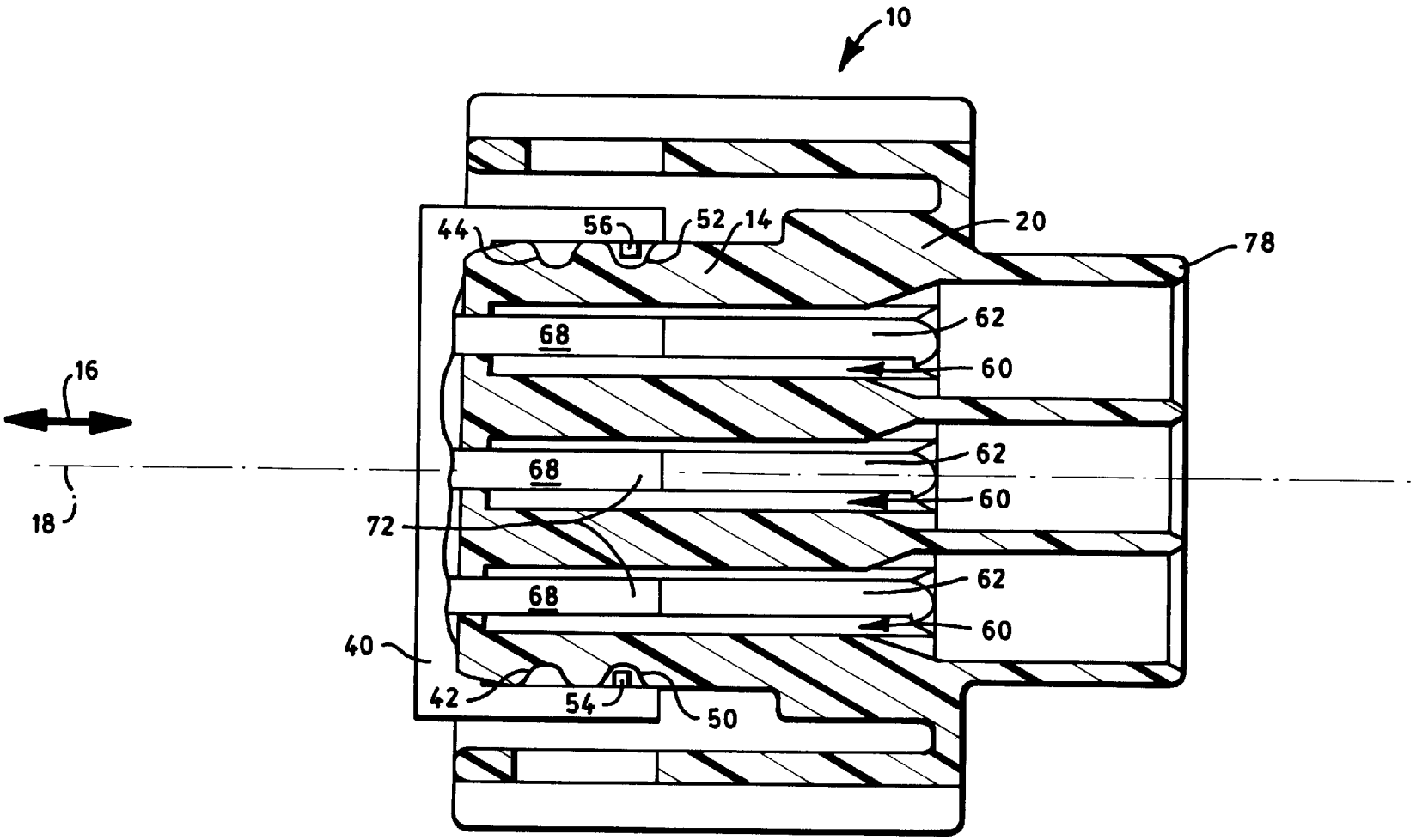
FIG. 5B is a cross section of the connector assembly of FIG. 3B taken along lines 5B—5B with the gasket 34, contacts 36 and conductors 38 omitted.

The inner housing of the connector assembly of the present invention includes at least a first and second latching member at the outer surface of the inner housing, the first and second latching members being spaced from each other in a longitudinal direction. In a preferred embodiment, such latching members include indentations in an outer surface of the inner housing. For example, as illustrated in FIGS. 5A and 5B, the inner housing 14 of the connector 10 includes a first pair of indentations 42 and 44 in outer surface 30, indentations 42 and 44 facing respective opposite sides 46 and 48 of the inner surface 32 of the outer housing 12. Inner housing 14 also includes a second pair of indentations 50 and 52 in outer surface 30, indentations 50 and 52 facing respective opposite sides 46 and 48. Indentations 42 and 44 are spaced from indentations 50 and 52 in direction 16 of axis 18.

The locking spacer of the present invention includes at least one mating latching member which engages a first latching member when the locking spacer is in the first attached position, and a second latching member when the locking spacer is in the second attached position. In a preferred embodiment, such mating latching members include detents which extend into respective first indentations when the locking spacer is in the first attached position, and into respective second indentations when the locking spacer is in the second attached position. For example, as illustrated in FIGS. 5A and 5B the locking spacer 40 includes a pair of detents 54 and 56. Detents 54 and 56 extend into indentations 42 and 44, respectively, when the locking spacer 40 is in the first attached position as illustrated in FIG. 5A. Similarly, detents 54 and 56 extend into indentations 50 and 52, respectively, when the locking spacer 40 is in the second attached position as illustrated in FIG. 5B.

In the embodiment illustrated in FIGS. 1 to 7, the locking spacer 40 mates with the outer surface 30 of the inner housing 14. In such embodiment the locking spacer 40 includes a hood 58 which covers an area of the open end 26 of the inner housing 40 as best illustrated in FIG. 4.

In the embodiment illustrated in FIGS. 1 to 7, the inner housing 14 includes a plurality of elongated channels 60 which extend in the inner cavity 28 in the direction 16 of axis 18 towards the open end 26 of the inner housing. A plurality of resilient cantilevered arms 62 extend in the inner cavity 28 of inner housing 14 in direction 16 of axis 18. Each arm 62 has a first end 64 attached to the inner housing 14 and a distal second end 66 extending towards the open end 26 as best illustrated in FIGS. 3A and 3B. Each arm 62 is adjacent a respective channel 60 as best illustrated in FIGS. 5A and 5B. The plurality of contacts 28 are positioned in the inner cavity 28 such that each contact 28 extends in a respective channel 60 and is contained therein by a respective arm 62 as best illustrated in FIGS. 3A and 3B.

Figure 7:
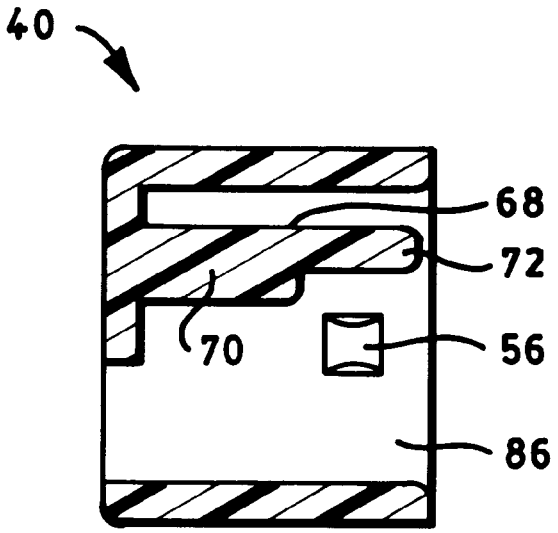
FIG. 7 is a cross section of the locking spacer of FIG. 6 taken along lines 7—7.
Figure 6:
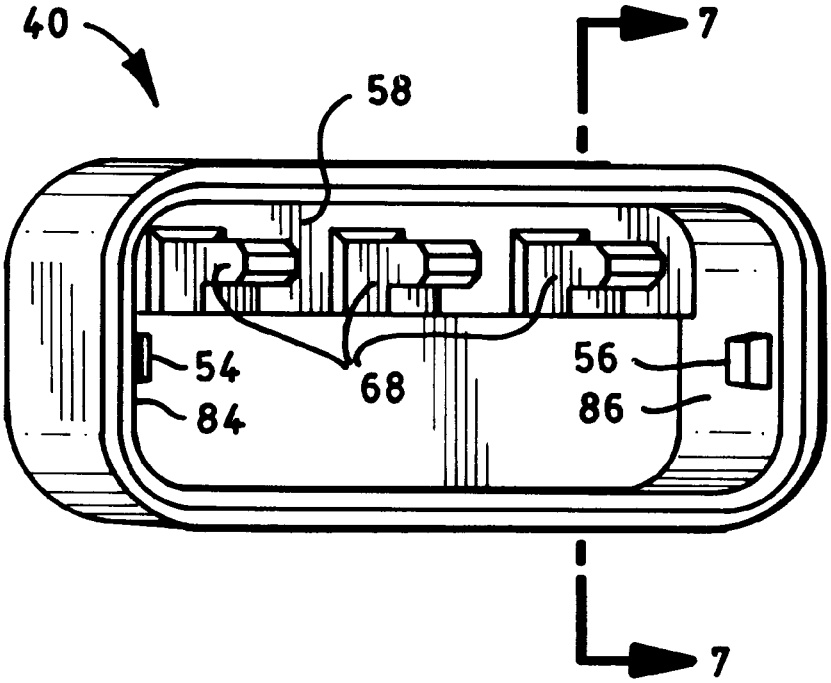
FIG. 6 is a perspective view of a locking spacer of the connector assembly of FIG. 1.

In one embodiment of the present invention, the locking spacer includes a plurality of cantilevered legs. For example, as illustrated in FIGS. 6 and 7, the locking spacer 40 includes legs 68. Each leg 68 includes a first end 70 attached to the locking spacer 40 and a distal second end 72. With reference to FIGS. 3A, 3B, 5A and 5B each leg 68 extends in the inner cavity 28 in the direction 16 of axis 18, the distal second end 72 extending towards the base 20. When the locking spacer is in the first attached position (FIGS. 3A and 5A), each leg 68 is spaced, in the direction 16, from a respective arm 62. In such position, each arm 62 is flexibly moveable in direction 74 away from a surface 76 of a respective channel 60 as illustrated in phantom lines in FIG. 3A. Such flexibility permits the insertion of a contact 36 into channel 60. In particular, a contact 36 may be inserted through opening 78 of the connector assembly 10 and urged towards the open end 26 of inner housing 14. In this manner, during its insertion contact 36 engages cam surface 80 of the arm 62 urging arm 62 in direction 74. When contact 36 is fully inserted in place the arm 62 will spring back towards the surface 76 such that the surface 82 of the arm will engage the contact and hold the contact in place as illustrated in solid lines in FIG. 3A.

When the locking spacer 40 is caused to slide to the second attached position (FIGS. 3B and 5B), each leg 68 will extend between a respective arm 62 and a surface 84 of the channel 20. In such position, each arm 62 will be engaged by a leg 68 and thereby prevented from being moved in direction 74 away from surface 76 of a respective channel 60 thereby locking each arm 62, and therefore each contact 36, in place within a channel 60. Further, the locking spacer 40 will engage the gasket 34 and hold it in place as illustrated in FIG. 3B. In the embodiment depicted in FIGS. 1 to 7, each leg 68 is attached to the locking spacer 40 at the hood 58 as best illustrated in FIG. 6.

It will be apparent to those skilled in the art that the connector assembly 10 may be provided to the user with the gasket 34 in place and the locking spacer 40 already attached to the inner housing 14 by means of the detents 54 and 56 inserted into respective indentations 42 and 44 in outer surface 30 of the inner housing in a first attached position. The user may insert the contacts 36 into the connector assembly 10 at opening 78 causing the contacts to be held in place by respective arms 62 as described herein. Then the user may lock the contacts 36 and gasket 34 in place by pushing the locking spacer 40 in direction 16 towards base 20 of the connector assembly 10. Pushing in this manner will cause the locking spacer to flex sufficiently such that the detents 54 and 56 will be removed from indentations 42 and 44, respectively, allowing the locking spacer to be moved further in the direction 16 towards base 20 until the detents 54 and 56 snap into indentations 50 and 52, respectively, and the locking spacer 40 engages the gasket 34, in a second attached position. When in the second attached position, the area of the open end 26 covered by the hood 58 will be adjacent respective distal ends of arms 62 as illustrated in FIGS. 3A, 3B and 4.

When in the second attached position, the connector assembly 10 will be ready for electrical and mechanical connection to a mating connector assembly (not shown) in a conventional manner. For example, in the embodiment illustrated in FIGS. 1 to 7, contacts 36 are female contacts, and the mating connector assembly will include elongated male prongs which may be inserted into respective female contacts 36. It will be apparent to those skilled in the art that contacts 36 may be male contacts which extend from the connector assembly 10 at open end 26 in which case the mating connector assembly will include mating female contacts.

If the connector assembly 10 is provided to the user without the gasket 34 in place, the user merely slides the gasket into the inner housing 14 at open end 26 until it abuts surface 20' of base 20, and attaches the locking spacer 40 to the inner housing by inserting the locking spacer into the open end 26 until the detents 54 and 56 snap into respective indentations 42 and 44. The connector assembly is then ready for insertion of contacts 36 as described herein. It will be apparent that the sequence of assembly may vary depending upon the application.

Figure 9:
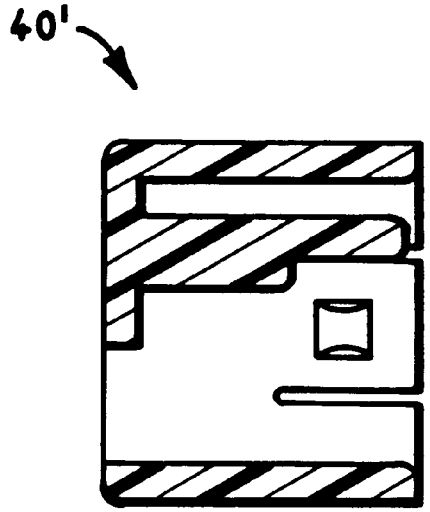
FIG. 9 is a cross section of the locking spacer of FIG. 8 taken along lines 9—9.
Figure 8:
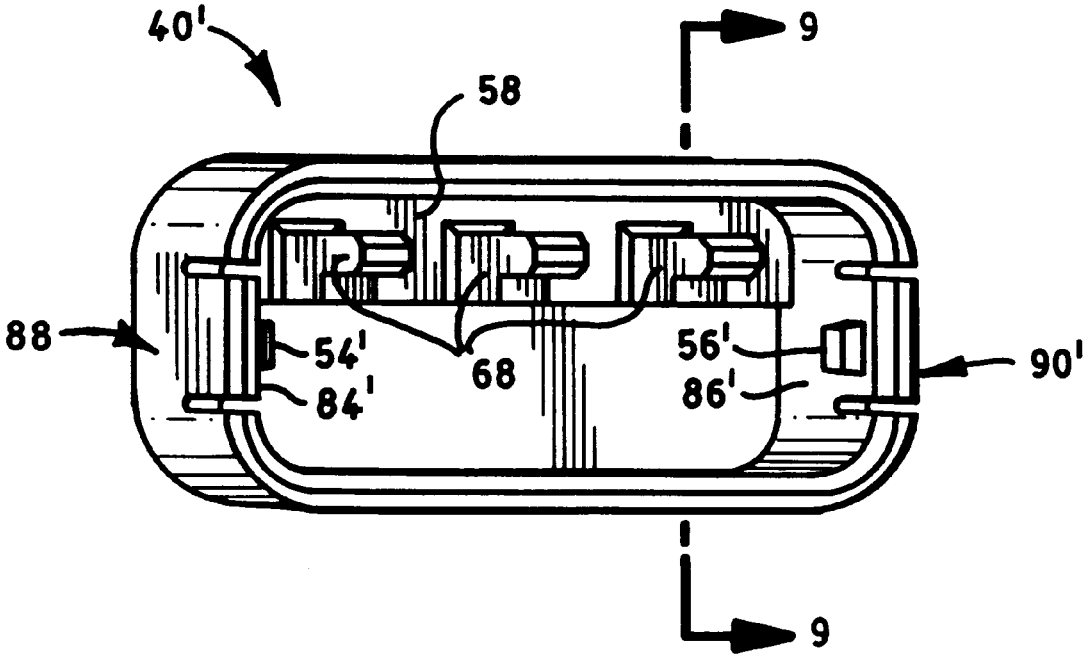
FIG. 8 is a perspective view of an alternative locking spacer of the present invention.

In the embodiment illustrated in FIGS. 6 and 7, the detents 54 and 56 extend from respective inner surfaces 84 and 86 of the locking spacer 40. By fabricating the locking spacer 40 from a plastic resilient material, the sides 84 and 86 will have sufficient flexibility to allow detents 54 and 56 to move into and out of respective indentations 42, 44 and 50, 52, as described herein. In the alternative embodiment illustrated in FIGS. 8 and 9, a locking spacer 40' is provided which is identical in structure and function to locking spacer 40 with the exception that the surfaces 84' and 86' are in the form of flexible latching beams 88 and 90. In use, the beams 88 and 90 will be urged into engagement with the inner housing 14 when the locking spacer 40' is in the first attached position and the second attached position. One or more flexible latching beams may be provided and in a preferred embodiment will include detents extending therefrom. For example, in the embodiment illustrated in FIGS. 8 and 9, flexible latching beams 88 and 90 include respective detents 54' and 56' which mate with respective indentations 42, 44 and 50,52 as described herein regarding detents 54 and 56.

Fabrication of the various components described herein may be accomplished using conventional procedures. For example, the housings and locking spacer may each be molded from a plastic material, such as, without limitation, nylon or polypropylene. The contacts may be stamped from a metal sheet and then rolled and/or bent as required to form the desired configuration. The gasket may be fabricated in a conventional manner using conventional rubber or rubber-like gasket material.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

We claim:

1. A connector assembly, comprising:

an outer housing extending in the direction of a first axis from a base of said outer housing to a first open end, said outer housing providing a first inner cavity therein;

an inner housing positioned within said first inner cavity and extending in said direction of said first axis from said base to a second open end, said inner housing providing a second inner cavity therein, a space provided between an outer surface of said inner housing and an inner surface of said outer housing, said inner housing being structured and arranged for containing a plurality of contacts in said second inner cavity extending towards said second open end, said inner housing further including at least one first indentation in said outer surface, and at least one second indentation in said outer surface spaced from said first indentation in said direction of said first axis, and further wherein said locking spacer includes at least one detent, said detent extending into said first indentation when said locking spacer is in said first attached position, and said detent extending into said second indentation when said locking spacer is in said second attached position;

a gasket in said space, said gasket being structured and arranged for engaging said base and said outer surface; and a locking spacer in said space and extending in said direction of said first axis from one open end to another open end, said locking spacer being slidable in said direction of said first axis between a first attached position disengaged from said gasket, and a second attached position engaged with said gasket to sandwich said gasket between said base and said locking spacer.

2. The connector assembly of claim 1 wherein said inner housing includes a first pair of indentations in said outer surface, the indentations of said first pair facing, respectively, opposite sides of said inner surface, and a second pair of indentations in said outer surface, the indentations of said second pair being spaced from the indentations of said first pair in said direction of said first axis and facing, respectively, said opposite sides, and said locking spacer including a pair of detents, a respective detent of said pair of detents extending (a) into a respective indentation of said first pair of indentations when said locking spacer is in said first attached position, and (b) into a respective indentation of said second pair of indentations when said locking spacer is in said second attached position.

3. The connector assembly of claim 1 wherein said locking spacer mates with said outer surface of said inner housing, and further wherein said locking spacer includes a hood which covers an area of said second open end of said inner housing.

4. The connector assembly of claim 1 wherein said inner housing includes:

a plurality of elongated channels extending in said second inner cavity in said direction of said first axis towards said second open end;

a plurality of flexible cantilevered arms extending in said second inner cavity in said direction of said first axis, each arm having a first end attached to said inner housing and a distal second end extending towards said second open end, a respective arm of said plurality of arms being adjacent a respective channel of said plurality of channels;

a respective contact of a plurality of contacts extending in a respective channel of said plurality of channels and being contained within said respective channel by a respective arm; and said locking spacer comprising a plurality of cantilevered legs extending in said second inner cavity in said direction of said first axis, each leg having a first end attached to said locking spacer and a distal second end extending towards said base, and (a) a respective leg of said plurality of legs being spaced in said direction of said first axis from a respective arm, and said respective arm being flexibly moveable into and out of locking engagement with a respective contact, when said locking spacer is in said first attached position, and (b) a respective leg of said plurality of legs extending between a respective arm of said plurality of arms, and an inner surface of said second housing, and said respective arm thereby being sufficiently immovable to retain said respective arm in locking engagement with said respective contact, when said locking spacer is in said second attached position.

5. The connector assembly of claim 4 wherein said locking spacer mates with said outer surface of said inner housing, and further wherein said locking spacer includes a hood which covers an area of said second open end of said inner housing.

6. The connector assembly of claim 5 wherein each first end of each respective leg is attached to said locking spacer at said hood.

7. The connector assembly of claim 6 wherein said area of said second open end covered by said hood is aligned with respective distal ends of respective arms of said plurality of arms.

8. The connector assembly of claim 1 wherein said locking spacer includes at least one flexible latching beam resiliently urged into engagement with said inner housing when said locking spacer is in said first attached position and said second attached position.

9. The connector assembly of claim 8 wherein said flexible latching beam includes a detent, said detent being resiliently urged into engagement with said inner housing when said locking spacer is in said first attached position and said second attached position.

10. The connector assembly of claim 1 wherein said locking spacer includes a first flexible latching beam and an opposite second flexible latching beam, said first and second latching beams being urged towards each other and into engagement with respective opposite sides of said inner housing when said locking spacer is in said first attached position and said second attached position.

11. The connector assembly of claim 10 wherein said first latching beam includes a first detent and said second latching beam includes an opposite second detent, said first and second detents being urged towards each other and into engagement with respective opposite sides of said inner housing when said locking spacer is in said first attached position and said second attached position.

12. The connector assembly of claim 11 wherein said first and second detents are urged into a respective first indentation of a first pair of indentations in opposite sides of said outer surface of said inner housing when said locking spacer is in said first attached position, and said first and second detents are urged into a respective second indentation of a second pair of indentations in opposite sides of said outer surface of said inner housing when said locking spacer is in said second attached position.

13. A connector assembly comprising:

an outer housing extending in the direction of a first axis from a base of said outer housing to a first open end, said outer housing providing a first inner cavity therein;

an inner housing positioned within said first inner cavity and extending in said direction of said first axis from said base to a second open end, said inner housing providing a second inner cavity therein, a space provided between an outer surface of said inner housing and an inner surface of said outer housing structured and arranged to contain a gasket, said inner housing being structured and arranged for containing a plurality of contacts in said second inner cavity extending towards said second open end, said inner housing including at least one first indentation in said outer surface, and at least one second indentation in said outer surface spaced from said first indentation in said direction of said first axis, and further wherein said locking spacer includes at least one detent, said detent being extendable into said first indentation when said locking spacer is in said first attached position, and said detent being extendable into said second indentation when said locking spacer is in said second attached position; and a locking spacer structured and arranged for sliding in said direction of said first axis between a first attached position located between said base and said first open end and a second attached position located between said base and said first attached position.

14. The connector assembly of claim 13 wherein said locking spacer includes at least one flexible latching beam structured and arranged to be resiliently urged into engagement with said inner housing when said locking spacer is in said first attached position and said second attached position.

15. The connector assembly of claim 13 wherein said locking spacer mates with said outer surface of said inner housing, and further wherein said locking spacer includes a hood which covers an area of said second open end of said inner housing.

* * * * *